US011109626B2

(12) United States Patent
Szochet

(10) Patent No.: US 11,109,626 B2
(45) Date of Patent: Sep. 7, 2021

(54) HEAT SHIELDING SLEEVE

(71) Applicant: Michael Mel Szochet, Fort Lauderdale, FL (US)

(72) Inventor: Michael Mel Szochet, Fort Lauderdale, FL (US)

(73) Assignee: THE PARACOSM GROUP, LLC, Miami, FL (US)

( * ) Notice: Subject to any disclaimer, the term of this patent is extended or adjusted under 35 U.S.C. 154(b) by 0 days.

(21) Appl. No.: 16/774,777

(22) Filed: Jan. 28, 2020

(65) Prior Publication Data

US 2021/0227905 A1 Jul. 29, 2021

(51) Int. Cl.

| | |
|---|---|
| ***A41D 27/28*** | (2006.01) |
| ***A41D 31/08*** | (2019.01) |
| ***A41D 27/12*** | (2006.01) |
| ***A41D 13/05*** | (2006.01) |
| ***A41D 13/005*** | (2006.01) |

(52) U.S. Cl.

CPC ..... *A41D 27/28* (2013.01); *A41D 13/0053* (2013.01); *A41D 13/0543* (2013.01); *A41D 27/12* (2013.01); *A41D 31/085* (2019.02)

(58) Field of Classification Search

None

See application file for complete search history.

(56) References Cited

U.S. PATENT DOCUMENTS 2,897,506 A * 8/1959 Carter ..... A41D 27/28 2/87
3,189,919 A * 6/1965 Chase ..... A41D 13/065 2/16
5,168,576 A * 12/1992 Krent ..... A41D 13/0156 2/456
6,775,851 B1 * 8/2004 Chen ..... A41D 13/0156 2/463
7,615,019 B2 * 11/2009 Nordt, III ..... A41D 13/05 602/16
7,615,023 B2 * 11/2009 Nordt, III ..... A41D 13/05 2/309
7,615,027 B2 * 11/2009 Nordt, III ..... A41D 13/05 602/19

(Continued)

*Primary Examiner* — Jocelyn Bravo
(74) *Attorney, Agent, or Firm* — Mark C. Johnson; Johnson Dalal

(57) ABSTRACT

A heat shielding sleeve defining a limb placement zone and including an installed position encapsulating a user's limb and an uninstalled position removed from a user's limb. The heat shielding sleeve further comprises an elastic or semi-elastic outer layer operably configured to enclose a user's leg and a secondary layer defined by a plurality of raised members wherein the secondary layer and the plurality of raised members are comprised of a thermally insulating material. The secondary layer further defines a plurality of exhaust apertures designed to provide thermal venting of the user's skin. The heat shielding sleeve is designed to protect motorcycle riders' and passengers' lower limbs from burns caused when riders and passengers come into physical contact with a motorcycle's exhaust pipes or the gas emissions emanating therefrom, while providing a comfortable and breathable garment sleeve that may be operably adjusted to the comfort of the user.

13 Claims, 4 Drawing Sheets

(56) References Cited

U.S. PATENT DOCUMENTS

| | | | | |
|---|---|---|---|---|
| 7,618,389 | B2 * | 11/2009 | Nordt, III | A41D 13/05 602/21 |
| 7,637,884 | B2 * | 12/2009 | Nordt, III | A41D 13/05 602/19 |
| 2002/0165475 | A1 * | 11/2002 | Chiang | A61F 5/0104 602/26 |
| 2003/0114782 | A1 * | 6/2003 | Chiang | A61F 5/01 602/6 |
| 2006/0026736 | A1 * | 2/2006 | Nordt, III | A41D 13/05 2/125 |
| 2007/0021706 | A1 * | 1/2007 | Braunstein | A61F 5/0109 602/63 |
| 2007/0077393 | A1 * | 4/2007 | Chiang | A61F 5/01 428/131 |
| 2007/0094762 | A1 * | 5/2007 | Carter | A41D 31/102 2/69 |
| 2008/0263744 | A1 * | 10/2008 | Di Giovanni | A41D 31/085 2/81 |
| 2011/0167529 | A1 * | 7/2011 | Anderson | A41D 13/08 2/2.5 |
| 2013/0061366 | A1 * | 3/2013 | Pezzimenti | A41D 31/02 2/69 |
| 2016/0366963 | A1 * | 12/2016 | Koshkaroff | A41D 27/28 |
| 2017/0035122 | A1 * | 2/2017 | Farron | A41D 3/02 |
| 2017/0099898 | A1 * | 4/2017 | Pezzimenti | A41D 1/04 |
| 2017/0100660 | A1 * | 4/2017 | Campbell | A42B 3/00 |
| 2017/0295869 | A1 * | 10/2017 | Choi | A41D 31/102 |
| 2018/0098588 | A1 * | 4/2018 | Pezzimenti | A41D 27/24 |

* cited by examiner

HEAT SHIELDING SLEEVE

FIELD OF THE INVENTION

The present invention relates generally to a wearable heat shielding sleeve designed to be worn around the calf area of a motorcycle user's leg and intended to protect the user from burns associated with motorcycle exhaust pipes.

BACKGROUND OF THE INVENTION

Motorcycle exhaust pipe burns are a global issue insofar as riders and passengers of motorcycles regularly experience this health issue when using motorcycles. Specifically, when users sit on a motorcycle and place their feet on the foot pegs, the exhaust pipe—the pipe which routes combustion gases away from users—is generally located immediately behind users' right calf. Due to the close proximity between a user's leg and a motorcycle's exhaust pipe, it is a commonplace occurrence for a user to accidentally move his/her leg onto the exhaust pipe, causing second degree burns to the exposed skin. Although wearing long pants or heat-resistant clothing may prevent the occurrence or degree of such burns, such apparel may be unappealing in design, uncomfortable or bulky when worn, or inappropriate for the climate of the region. Relevant prior art comprises devices which must be secured to the leg with straps and snaps, rather than with one unitary sleeve that can easily be slipped on and off. As a result, regular use of the relevant prior art is often interrupted and becomes unlikely in light of these disadvantages. Notably, the relevant prior art lacks built-in design features to vent and aerate the encapsulated limb area, resulting in the formation of condensation on the encapsulated area which hinders the gripping capability of the material.

Therefore, a need exists to overcome the problems with the prior art as discussed above.

SUMMARY OF THE INVENTION

The invention provides a wearable heat shielding sleeve that overcomes the hereinafore-mentioned disadvantages of the heretofore-known devices and methods of this general type and that provides for efficient thermal protection of the calf and foot from the heat of a motorcycle exhaust pipe and gas emissions emanating therefrom.

With the foregoing and other objects in view, there is provided, in accordance with the present invention, a heat shielding sleeve comprising a sleeve body having a first layer and a second layer, wherein the first layer may be of a substantially polyester elastane material and the second layer may be of a heat resistant polymeric material.

In accordance with the present invention, the first layer comprises a distal end, a proximal end, and a sleeve length separating the proximal and distal ends of the sleeve and defining a limb placement cylindrical channel wherein a user's lower limb, e.g. leg, may be inserted.

In accordance with another feature, the second layer is superimposed and directly coupled to the outer surface of the sleeve, the second layer further having a plurality of raised members radially extending outwardly away from the outer surface and defining raised surfaces spatially offset from the outer surface of the first layer.

In accordance with another feature, the second layer further defines a plurality of perimeter channels spanning around the plurality of raised members and not necessarily enclosed on all sides.

In accordance with the present invention, the exhaust apertures extend through the second layer and thermally vent the user's skin during use.

Although the invention is illustrated and described herein as embodied in a heat shielding sleeve, it is, nevertheless, not intended to be limited to the details shown because various modifications and structural changes may be made therein without departing from the spirit of the invention and within the scope and range of equivalents of the claims. For example, while its perceived most advantageous application is for motorcycle users, it may be effective for other applications, e.g., go-carts. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the cantilevered handle member.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

Figure 1:
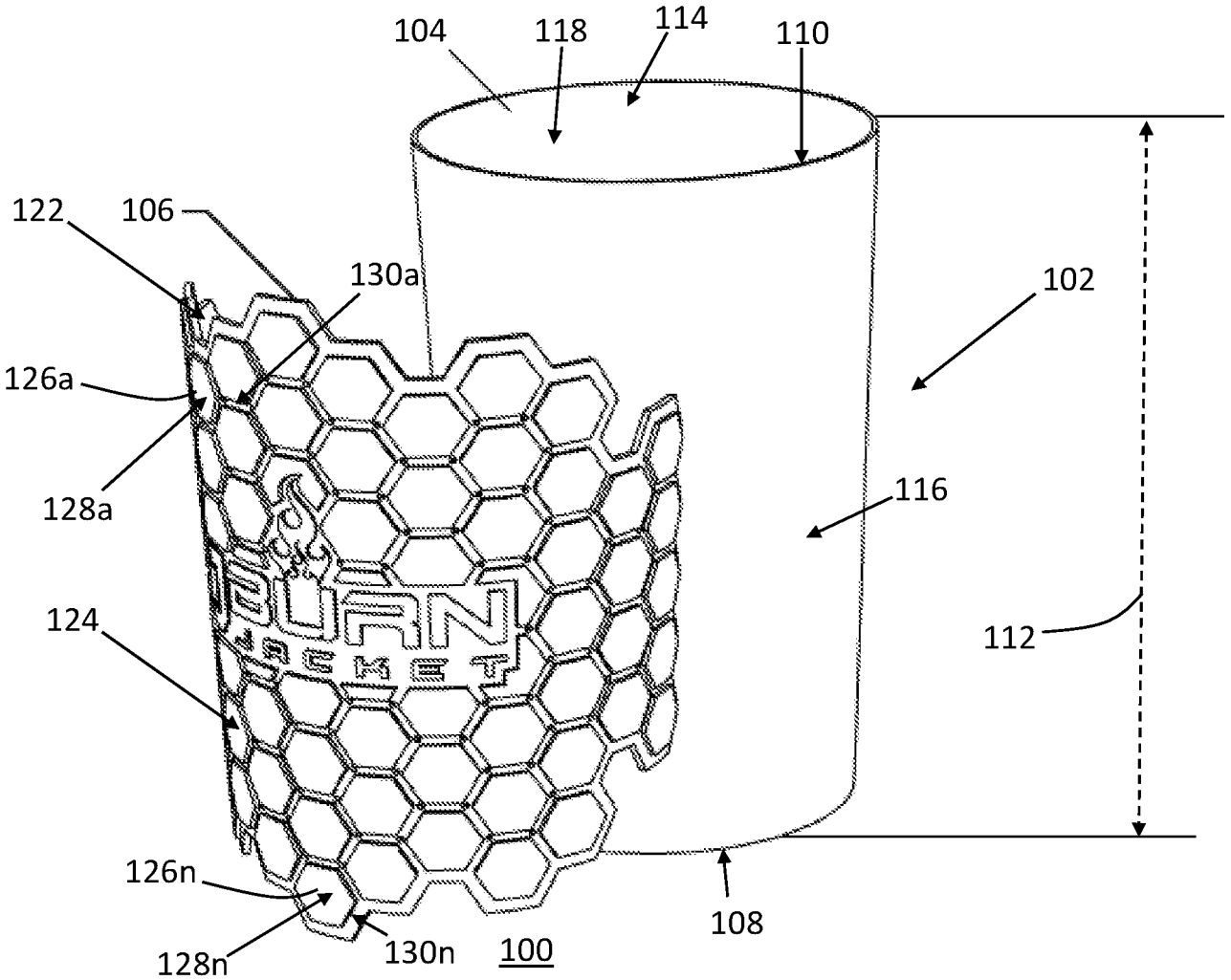
FIG. 1 is a perspective exploded view of a heat shielding sleeve in accordance with an exemplary embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient way of protecting users from the sting and pain of motorcycle exhaust pipe burns. As best seen in FIG. 1, an exemplary embodiment of a heat shielding sleeve 100 is shown. Specifically, FIG. 1 shows several advantageous features of the present invention, but, as will be described below, the invention can be provided in several shapes, sizes, combinations of features and components, and varying numbers and functions of the components. Further, the heat shielding sleeve 100 may comprise either an installed position encapsulating a user's limb, wherein the user is wearing the heat shielding sleeve 100 around his/her lower limb, i.e., a leg, or an uninstalled position removed from a user's limb, wherein the heat shielding sleeve 100 is at rest and ready for use.

The heat shielding sleeve 100 comprises a first layer 104 with a distal end 108, wherein distal represents a location or physical disposition facing downward, a proximal end 110, wherein proximal represents a location or physical disposition facing upward, opposing the distal end 108, and a sleeve length 112 separating the distal and proximal ends 108, 110 of the sleeve first layer 104.

The sleeve length 112 may range approximately 12-36 inches in one embodiment, but may be another length outside of said range in other embodiments. The first layer 112 includes an inner surface 114 enclosing and defining a limb placement cylindrical channel 118 and an outer surface 120 opposing the inner surface 114 of the first layer 104, and of an elastically deformable material, e.g., a polyester elastane material.

Figure 4:
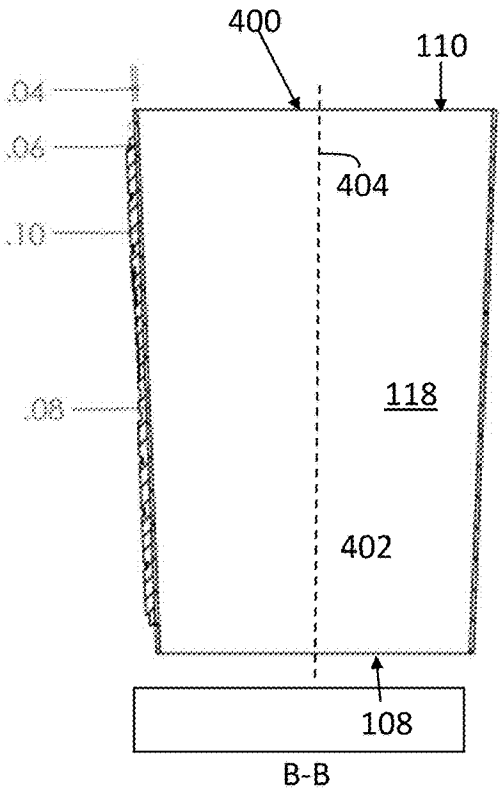
FIG. 4 is a cross-sectional view of the heat shielding sleeve in FIG. 2 along section line B-B.
Figure 3:
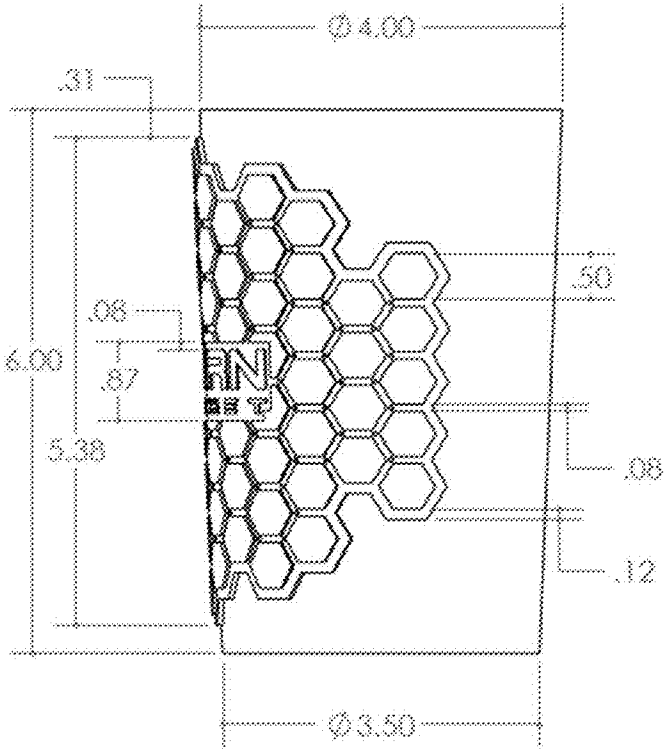
FIG. 3 is an elevational side view of the heat shielding sleeve in FIG. 2.
Figure 2:
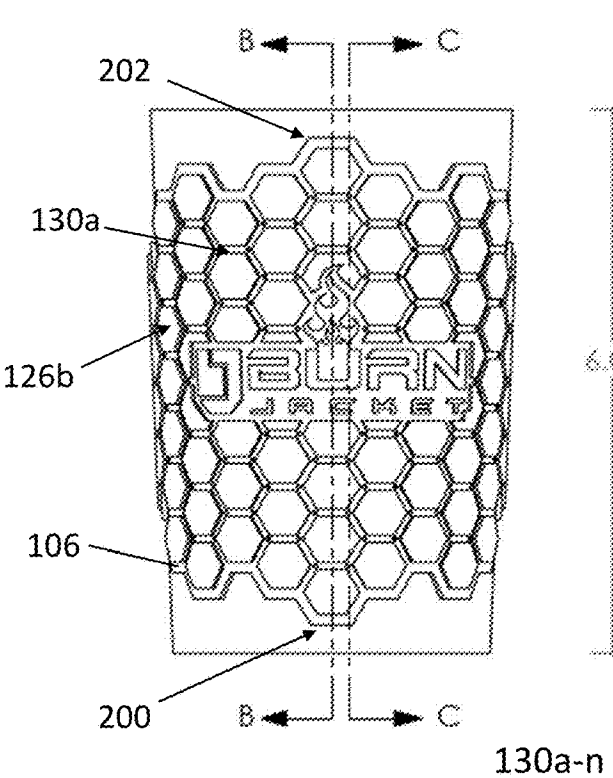
FIG. 2 is an elevational front view of the heat shielding sleeve in FIG. 1 with a first layer and a second layer coupled together in accordance with one embodiment of the present invention.

In an exemplary embodiment of the present invention, and as best seen in FIGS. 2-4, the first layer 104 is comprised of a deformable elastic or semi-elastic material, e.g., polyester or spandex, operably configured to flexibly enclose a user's limb, e.g., leg. The elastically deformable material facilitates comfortable movement of the user's limb while maintaining a breathable quality that facilitates aeration of the encapsulated limb area. In this way, the accumulation of condensation on the surface of the user's skin is prevented and a tight fit around the user's limb is maintained.

The first layer 104 may be formed as a unitary and enclosed material defining the limb placement channel 118, whereby a user applies a tensile force laterally to expand the first layer 104 and the user's limb is inserted within the limb placement channel 118. The tensile force may then be released, and the first layer 104 will be frictionally and/or compressively retained on the user's limb with compressional forces exerted by the elastic nature of the material of the first layer 104. In this embodiment of the invention, the proximal end 110, which may define a proximal opening, is approximately four inches in diameter and the first layer 104 is approximately 0.04 inches thick. The distal end 108 may also define a proximal opening that may be substantially the same diameter as the proximal opening. In a preferred embodiment, when desired for use on a limb where one portion is larger in diameter than another, the distal opening may be sized smaller than the proximal opening. As such, the user may slide the sleeve onto his or her limb through the distal and proximal openings.

In other embodiments, the first layer 104 may be opened and closed longitudinally to expose and access the limb placement channel 118 by the user through use of a fastener, e.g., Velcro. When opened, the user would then place their limb within the limb placement channel 118, whereby the user would then close the first layer 104 with the fastener to retain the heat shielding sleeve 100 on the user's limb.

Beneficially, the heat shielding sleeve 100 includes a second layer 106 of a thermally insulating material, e.g., silicone, superimposed on the first layer 104, wherein the second layer 106 has a low thermal conductivity, e.g., 0.02-0.1 (W/(m×K)). The second layer 106 comprises an inner surface 122 superimposed and directly coupled to the outer surface 120 of the first layer 104 and an outer surface 124 opposing the inner surface 122 of the second layer 106. The second layer 106 may be coupled to the first layer 104 using, for example, an adhesive or other comparable bonding or coupling agent.

The second layer 106 further comprises a plurality of raised members **126*a-n* (wherein "n" represents any number greater than one) radially, wherein radially represents a distance spanning around the outside radius of the second layer 106, extending outwardly away from the outer surface 120. The plurality of raised members 126*a-n* each include respective raised surfaces 128*a-n* spatially offset from the outer surface 120 of the first layer 104 of the sleeve body 102. defining a plurality of perimeter channels 130*a-n* (wherein "n" represents any number greater than one). The raised members 126*a-n* are spatially offset from the first layer 104, and ultimately from the user's limb, to shield the user from a heat source, e.g., an exhaust pipe from a motorcycle or convectional air or heat generated from the exhaust pipe. As seen in FIGS. 1-3 and FIG. 6, the respective raised surfaces 128***a-n* define the outermost exterior of the sleeve body 102 and also define the outer surface 124 of the second layer 106. In addition, the plurality of raised members 126*a-n* on the second layer 106 can be seen having an irregular and non-planar configuration with respect to both the distal terminal end 108 and proximal terminal end 110 of the first layer 104.

In one embodiment, the second layer 106 is of a heat resistant polymeric material spanning longitudinally at least 50% of the sleeve length 112. In another embodiment, the second layer 106 is of a heat resistant polymeric material spanning longitudinally at least 90% of the sleeve length 112. Further, the second layer 106 may span circumferentially around at least 50% of a circumference of the first layer 104. In other embodiments, the second layer 106 may span circumferentially around at least 70-80% of a circumference of the first layer 104 so as to sufficiently cover the circumference of the first layer 104. With reference to FIGS. 1-3, the second layer 106 includes two opposing ends 200, 202 and a length separating the two opposing ends 200, 202 and spanning longitudinally over the outer surface 120 of the first layer 104 less than a length separating the distal terminal and proximal terminal ends 108, 110 of the first layer 104. As best seen in FIG. 1 and FIG. 4 and as referenced above, the proximal terminal opening 400 defined by the proximal terminal end 110 and the distal terminal opening 402 defined by the distal terminal end 110 are axially aligned with one another about an axis 404 extending and spanning longitudinally from the distal terminal opening 402 to the proximal terminal opening 400. Also, with reference to FIG. 6, the exhaust apertures 400*a-n* extend from an upper opening and through the second layer 106 until reaching a lower portion adjacent to the first layer 104 that traverses across the lower portion of each of the plurality of exhaust enclosed apertures 400*a-n* for thermally venting and protecting a user's skin.

In an exemplary embodiment, the plurality of raised members 126*a-n* have an approximate thickness of 0.10 inches and are defined by an arrangement of alternating polygonal shapes, e.g., hexagonal shapes, creating a "honeycomb" textured arrangement. In other embodiments of the present invention, the plurality of raised members 126*a-n* may be of a variety of polygonal shapes or forms. The raised members 126*a-n* may be comprised of a thermally insulating material, e.g., silicone or another substantially insulating material, defined by a low thermal conductivity, e.g., 0.02-0.1 (W/(m×K)).

The perimeter channels 130*a-n* define the raised members 126*a-n* and span alongside the outer length of the raised members 126*a-n* but may be enclosed on any number of sides by the raised members 126*a-n*. In some embodiments, the perimeter channels 130*a-n* are defined by two flanking sidewalls of the raised members 126*a-n*, while in other embodiments the perimeter channels 130*a-n* are defined by only one sidewall of a raised member 126.

As further seen in FIGS. 2-6, the second layer 106 beneficially defines a plurality of ventilation or exhaust enclosed apertures 400*a-n* (wherein "n" represents any number greater than one) disposed within at least one of the plurality of perimeter channels 130*a-n* and extending through the second layer 106 for thermally venting a user's skin. As such, the user can sufficiently protect their skin, while simultaneously aerating or providing air to the first layer 104 and/or the user's skin, thereby minimizing slippage of sleeve caused by perspiration. The exhaust apertures 400*a-n* configured to provide the user's limb with fluid and heat transfer more effective than those similarly known devices. Specifically, in one embodiment, only the second layer 106 includes specially configured exhaust apertures 400*a-n*, each approximately 0.05 inches in diameter. These exhaust apertures 400*a-n* may be interposed in various locations along the longitudinal and lateral length of the second layer 106. The exhaust apertures 400*a-n* are of a diameter sufficient to permit heat and fluid transfer yet, in combination with the raised surfaces displacing the exhaust pipe from the user, small enough to minimize (or eliminate) the risk of burning the user from the heat source, e.g. a motorcycle exhaust pipe.

Figure 6:
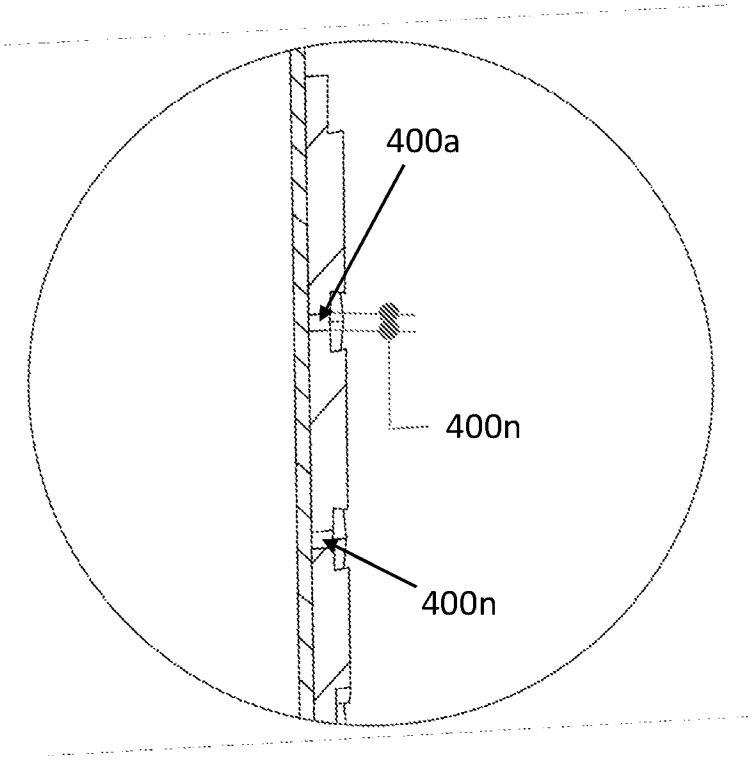
FIG. 6 is a partial cross-sectional view of the heat shielding sleeve in FIG. 2 along section line C-C.
Figure 5:
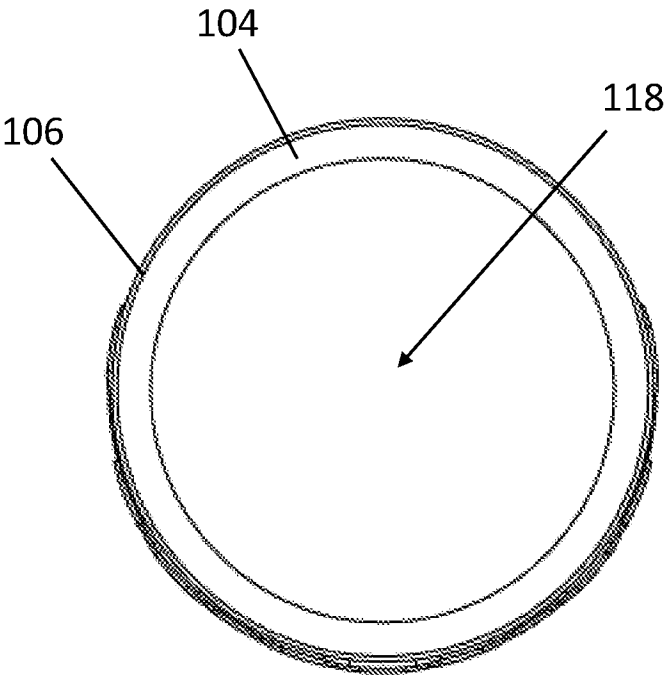
FIG. 5 is a top plan view of the heat shielding sleeve in FIG. 2.

FIG. 5 depicts a top plan view of one embodiment of the heat shielding sleeve 100, while FIG. 6 depicts a close-up cross-sectional partial view of a portion of the sleeve depicted in FIG. 2. The variations in thickness of the first layer 104, the second layer 106, and the raised members 126*a-n* are best depicted in FIGS. 2-4.

In some embodiments of the present invention, the exhaust apertures 400*a-n* may be of a potentially uniform diameter and spacing may be disposed between the plurality of raised members 126*a-n*. In preferred embodiments, over fifty percent (50%) of the area defining the perimeter channels 130*a-n* includes exhaust apertures 400*a-n*. In some embodiments, the second layer 106 may cover greater than fifty percent (50%) of the first layer 104, while in other embodiments, the second layer 106 may be disposed in a target area configured for contacting the heat source. In further embodiments, the exhaust apertures 400*a-n* may also span through the first layer 104, thereby placing the user's skin in fluid communication with an ambient environment. Additionally, the exhaust apertures 400*a-n* may also span through the plurality of polygonal raised members 126*a-n*, as well.

Figure 8:
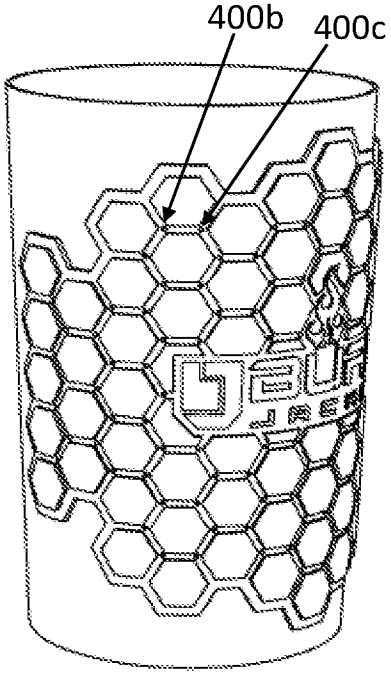
FIG. 8 is a right-side perspective view of the heat shielding sleeve in FIG. 2.
Figure 7:
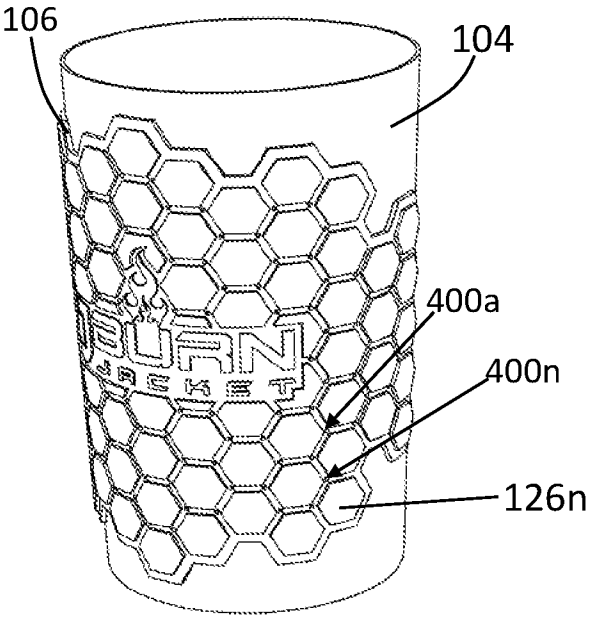
FIG. 7 is a left-side perspective view of the heat shielding sleeve in FIG. 2.

As seen best in FIG. 2, FIG. 4, and FIG. 6, the plurality of exhaust enclosed apertures 400*a-n* are each respectively located proximal to a vertex defined by one of the plurality of raised members 126*a-n*. FIGS. 7-8 depict an exemplary embodiment of the present invention, comprising the first layer 104, the second layer 106, the plurality of raised members 126*a-n*, and the plurality of exhaust apertures 400*a-n*.

What is claimed is:

1. A heat shielding sleeve comprising:

a sleeve body having:

a first layer having a distal terminal end defining a distal terminal opening, a proximal terminal end opposing the distal terminal end and defining a proximal terminal opening, an axis extending longitudinally from the distal terminal opening to the proximal terminal opening, a sleeve length extending from the proximal terminal end to the distal terminal end, an inner surface enclosing and defining a limb placement cylindrical channel, and an outer surface opposing the inner surface, wherein the first layer is comprised of an elastically deformable material, and the distal terminal opening and the proximal terminal opening are axially aligned with one another about the axis spanning from the distal terminal opening to the proximal terminal opening; and a second layer having an inner surface superimposed and directly coupled to the outer surface of the first layer, an outer surface opposing the inner surface of the second layer, and a plurality of raised members radially extending outwardly away from the outer surface of the first layer and defining respective raised surfaces spatially offset from the outer surface of the first layer of the sleeve body, the plurality of raised members defining a plurality of perimeter channels completely surrounding the respective raised surfaces, the plurality of raised members further defining an irregular and non-planar distal perimeter edge with respect to the distal terminal end of the first layer, and an irregular and non-planar proximal perimeter edge with respect to the proximal terminal end of the first layer;

the second layer spanning longitudinally and continuously at least 50% of the sleeve length and defining a plurality of exhaust enclosed apertures each respectively disposed within at least one of the plurality of perimeter channels, each aperture:

having an outer opening disposed at the outer surface of the second layer and having an inner opening disposed at the inner surface of the second layer;

extending through the second layer from the respective outer opening to the respective inner opening, wherein the first layer extends along the inner surface of the second layer so as to cover the inner opening of each aperture; and having a diameter of approximately 0.05 inch for thermally venting and protecting a user's skin.

2. The heat shielding sleeve according to claim 1, wherein:

the first layer includes a polyester elastane material.

3. The heat shielding sleeve according to claim 1, wherein:

the plurality of raised members are of a polygonal shape.

4. The heat shielding sleeve according to claim 3, wherein:

the plurality of exhaust enclosed apertures are each respectively located proximal to a vertex defined by one of the plurality of raised members.

5. The heat shielding sleeve according to claim 4, wherein:

the second layer is of a heat resistant polymeric material.

6. The heat shielding sleeve according to claim 5, wherein:

the heat resistant polymeric material spans longitudinally at least 90% of the sleeve length.

7. The heat shielding sleeve according to claim 5, wherein:

the second layer spans circumferentially around at least 50% of a circumference of the first layer.

8. The heat shielding sleeve according to claim 1, wherein the second layer further comprises:

two opposing ends and a length separating the two opposing ends and wherein the length of the second layer is shorter than the sleeve length.

9. A heat shielding sleeve comprising:

a sleeve body consisting of:

a first layer having a distal terminal end defining a distal terminal opening, a proximal terminal end opposing the distal terminal end and defining a proximal terminal opening axially aligned and spatially overlapping with the distal terminal opening, an axis extending longitudinally from the distal terminal opening to the proximal terminal opening, a sleeve length extending from the proximal terminal end to the distal terminal end, an inner surface enclosing and defining a limb placement cylindrical channel spatially coupled to the distal and proximal openings, and an outer surface opposing the inner surface of the first layer, wherein the first layer is comprised of an elastically deformable material, and the distal terminal opening and the proximal terminal opening are axially aligned with one another about the axis spanning from the distal terminal opening to the proximal terminal opening; and a second layer having an inner surface superimposed and directly coupled to the outer surface of the first layer, an outer surface opposing the inner surface of the second layer, and a plurality of raised members radially extending outwardly away from the outer surface of the first layer, the plurality of raised members each having a polygonal shape and defining respective raised surfaces spatially offset from the outer surface of the first layer, the raised surfaces defining an outermost exterior of the sleeve body and defining the outer surface of the second layer, the plurality of raised members further defining a plurality of perimeter channels completely surrounding the respective raised surfaces, the second layer spanning longitudinally and continuously at least 50% of the sleeve length and defining a plurality of exhaust enclosed apertures each respectively disposed within at least one of the plurality of perimeter channels, each aperture having an outer opening disposed at the outer surface of the second layer and an inner opening disposed at the inner surface of the second layer, each aperture extending from the respective outer opening and through the second layer until reaching the respective inner opening, wherein the first layer extends along the inner surface of the second layer so as to cover the inner opening of each aperture, and each aperture having a diameter of approximately 0.05 inch for thermally venting and protecting a user's skin.

10. The heat shielding sleeve according to claim 9, wherein:

the plurality of exhaust enclosed apertures are each respectively located proximal to a vertex defined by one of the plurality of raised members.

11. The heat shielding sleeve according to claim 10, wherein:

the second layer is of a heat resistant polymeric material.

12. The heat shielding sleeve according to claim 11, wherein:

the second layer spans circumferentially around at least 50% of a circumference of the first layer.

13. The heat shielding sleeve according to claim 9, wherein the second layer further comprises:

two opposing ends and a length separating the two opposing ends and wherein the length of the second layer is shorter than the sleeve length.

* * * * *